US008806688B2

(12) United States Patent
Edgeworth et al.

(10) Patent No.: US 8,806,688 B2
(45) Date of Patent: Aug. 19, 2014

(54) FOOTWEAR AND METHOD OF MAKING THEREOF

(75) Inventors: Angela Edgeworth, Henderson, NV (US); Brian Edgeworth, Henderson, NV (US)

(73) Assignee: Pediped Infant Footwear LLC, Henderson, NV (US)

( * ) Notice: Subject to any disclaimer, the term of this patent is extended or adjusted under 35 U.S.C. 154(b) by 20 days.

(21) Appl. No.: 13/532,100

(22) Filed: Jun. 25, 2012

(65) Prior Publication Data

US 2012/0324657 A1 Dec. 27, 2012

Related U.S. Application Data

(62) Division of application No. 11/644,005, filed on Dec. 22, 2006, now Pat. No. 8,205,358.

(51) Int. Cl.
*A43B 9/02* (2006.01)
*A43B 13/28* (2006.01)
*A43B 3/30* (2006.01)

(52) U.S. Cl.
CPC . *A43B 9/02* (2013.01); *A43B 13/28* (2013.01); *A43B 3/30* (2013.01)
USPC ..... 12/142 T; 36/12; 36/21; 36/112

(58) Field of Classification Search
CPC ..... A43B 9/00; A43B 9/02; A43B 3/30; A43B 13/28; A43B 13/42
USPC ..... 36/12, 18, 19 R, 19 A, 21, 112; 12/28, 12/32.1, 142 B, 142 C, 142 T, 142 K, 142 G, 12/142 MC; 112/29, 45, 58
See application file for complete search history.

(56) References Cited

U.S. PATENT DOCUMENTS

| | | | |
|---|---|---|---|
| 45,138 | A | 11/1864 | Closs |
| 2,119,392 | A | 5/1938 | Levin |
| 2,364,816 | A | 12/1944 | Quinn |
| 2,460,097 | A | 1/1949 | Maling |
| 2,469,647 | A | 5/1949 | Hollander |
| 2,535,560 | A | 12/1950 | Barr |
| 2,718,715 | A | 9/1955 | Spilman |

(Continued)

OTHER PUBLICATIONS

RE7,154, issued Jun. 1876, Inventor Drake.

(Continued)

*Primary Examiner* — Khoa Huynh
*Assistant Examiner* — Sharon M Prange
(74) *Attorney, Agent, or Firm* — Baker & Hostetler LLP

(57) ABSTRACT

Footwear includes an upper, a sole, and a thread. The upper has upper holes around the upper peripheral. The sole has a lip portion on the sole peripheral lip portion has sole holes around the sole peripheral. The thread attaches the upper and the sole through the upper holes and the sole holes, and forms a set of stitches. A ripple is formed between two sets of stitches and the thread is embedded in the lip portion between the ripples. Each stitch goes through a first upper hole and enters the sole hole of the lip portion, such that the thread forms an angled stitch on the lip portion. The thread then goes through a second upper hole and exits from a third upper hole, such that the thread forms a horizontal stitch on the inside of the footwear.

12 Claims, 9 Drawing Sheets

(56) References Cited

U.S. PATENT DOCUMENTS

| | | | | |
|---|---|---|---|---|
| 2,820,308 | A | 1/1958 | Hiestand | |
| 3,135,060 | A | 6/1964 | McConnell | |
| 4,034,431 | A | 7/1977 | Fukuoka | |
| 4,161,827 | A | 7/1979 | Roberts et al. | |
| 5,575,087 | A * | 11/1996 | Ehrhart et al. | 36/11 |
| 6,226,894 | B1 | 5/2001 | Bray, Jr. et al. | |
| 6,662,469 | B2 | 12/2003 | Urie et al. | |
| 6,763,610 | B2 | 7/2004 | Issler | |
| 6,966,128 | B2 | 11/2005 | McClaskie | |
| 6,971,191 | B2 | 12/2005 | Issler | |
| 6,976,320 | B2 | 12/2005 | McClaskie | |
| 7,020,987 | B2 | 4/2006 | Issler | |
| 7,237,345 | B2 | 7/2007 | Thomas | |
| 7,454,848 | B2 | 11/2008 | Issler | |
| 2004/0231196 | A1 | 11/2004 | Kassai et al. | |

OTHER PUBLICATIONS

Pedoodles Website, http://web.archive.org/web/20050210043043/http:/www.pedoodles.com (Sep. 28, 2010).

* cited by examiner

FOOTWEAR AND METHOD OF MAKING THEREOF

CROSS-REFERENCE TO RELATED APPLICATIONS

This application claims priority to and is a divisional of U.S. patent application entitled "Footwear and Method of Making Thereof," filed Dec. 22, 2006, having Ser. No. 11/644,005, the disclosure of which is hereby incorporated by reference in its entirety.

FIELD OF THE INVENTION

The present invention relates generally to footwear. More particularly, the present invention relates to a stitching method for infants' and young children's footwear.

BACKGROUND OF THE INVENTION

The main function of shoes is to protect our feet. More specifically, the primary function of modern footwear is to provide feet with protection from hard and rough surfaces, as well as climate and environmental exposure. Nowadays, shoes come in all shapes and styles to accommodate different purposes, activities, or functions. However, in order for shoes to serve their intended purpose, the proper shoes must be chosen for the right situation.

In particular, the proper shoes must be chosen for infants and children who are in their early development of their feet. In the past, the soles of infants' shoes were made to be stiff and hard because it was generally believed that stiff and hard soles provided support for children's feet. However, because the feet of young children are soft and pliable, pressure from the wrong type of shoes can be detrimental to the development of their feet. Therefore, it is important to provide footwear for infants and young children that provides protection from hard and rough surfaces, while allowing their soft and pliable feet to develop.

Efforts were made to overcome this problem and footwear with soft soles were introduced to the market. These soft-sole shoes are typically sewn together by machine. The problem with this type of soft-sole shoes is that the shoes do not provide ventilation for the infants' and young children's feet. Therefore, it is important to provide soft-sole footwear that is breathable.

Furthermore, it is important to provide footwear that can endure extended contact with surfaces. During early development, young children often crawl on the ground and, therefore, the toe and surrounding portions of their shoes drag and rub on the ground. Thus, it is important to provide footwear with special stitching that can withstand such contact with rough surfaces.

Accordingly, it is desirable to provide footwear for infants and young children, which allows their young feet to develop and endure contact with rough surfaces without falling apart, and the method of making the footwear.

SUMMARY OF THE INVENTION

The foregoing needs are met, to a great extent, by the present invention, wherein in one aspect an apparatus is provided that in some embodiments includes breathable footwear with a soft sole that provides embedded stitches that avoid direct contact with rough surfaces.

In accordance with one embodiment of the present invention, footwear is provided, and includes an upper, a sole, and a thread. The upper having upper holes around an upper peripheral. The sole having a lip portion on the sole peripheral; wherein the lip portion having sole holes around the sole peripheral. The thread attaching the upper and the sole through the upper holes and the sole holes, and forming a set of stitches, wherein at least one ripple is formed between two sets of stitches, and wherein the thread is embedded in the lip portion and between the ripples. The thread forms angled stitches on the lip portion of the outside of the footwear and horizontal stitches on the inside of the footwear. The set of stitches including the thread coming through a first upper hole and entering the sole hole of the lip portion, such that the thread forms an angled stitch on the lip portion, and wherein the thread then goes through a second upper hole and exits from a third upper hole, such that the thread forms a horizontal stitch on the inside of the footwear.

In accordance with another embodiment of the present invention, a method for providing footwear is presented, which includes providing an upper having upper holes along an upper peripheral, providing a sole having a lip portion on a sole peripheral, wherein the lip portion having sole holes along the sole peripheral, and stitching the upper and the sole using a thread that forms a set of stitches, wherein at least one ripple is formed between the two set of stitches, and wherein the thread is embedded in the lip portion and between the ripples. The stitching includes pulling the thread through a first upper hole from the inside of the upper, sending the thread through a sole hole from the outer side of the lip portion, thereby forming an angled stitch on the lip portion of the sole, pushing the thread through a second upper hole from the outside of the upper, and pulling the thread through a third upper hole from the inside of the upper, thereby forming a horizontal stitch on the inside portion of the upper. The method further includes providing a strap on the upper having one side of a two-sided fastener and providing the second side of the two-sided fastener to the upper.

In accordance with yet another embodiment of the present invention, a stitching method for a shoe including: pulling a thread through a first upper hole from the inside to the outside of an upper; sending the thread through a sole hole from the outside of a lip portion of a sole, thereby forming an angled stitch on the lip portion of the sole; pushing the thread through a second upper hole from the outside to the inside of the upper; and pulling the thread through a third upper hole from the inside of the upper, thereby forming a horizontal stitch on the inside portion of the upper, wherein at least one ripple is formed between two angled stitches, and wherein the angled stitches are embedded between two ripples.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
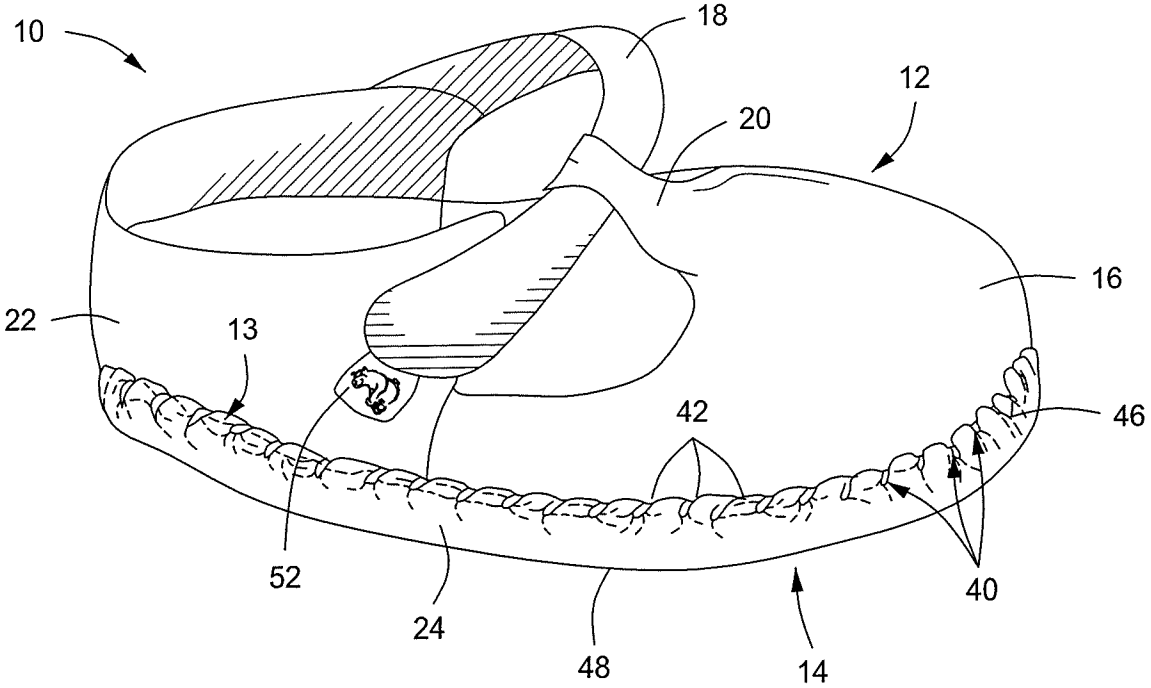
FIG. 1 is a perspective view illustrating the footwear according to an embodiment of the invention.

The invention will now be described with reference to the drawing figures, in which like reference numerals refer to like parts throughout. An embodiment in accordance with the present invention provides breathable footwear with a soft sole that provides embedded stitches that avoid direct contact with rough surfaces.

An embodiment of the present inventive apparatus is illustrated in FIG. 1, which is a perspective view of an outer layer 16 of a footwear 10. The footwear 10 can include an upper 12 and a sole 14. The upper 12 and the sole 14 are sewn together by a thread 13.

The upper 12 can also include a vamp portion 20, a heel portion 22, and a strap 18. The strap 18 can be optionally connected to the vamp portion 20 through a loop on the vamp portion 20. In another embodiment, the strap 18 is not connected to the vamp portion 20. In addition, a tag 52 can be at the end of the strap 18 and can contain information such as a logo bearing the brand name or the trademark of the shoes. For example, for PEDIPED® Footwear, the tag 18 includes a bear.

The upper can be made of materials such as patent leather, genuine leather, leather rawhide, napa leather, polyester urethane material, suede, polyester fabric, cotton fabric, synthetic fabric, and other suitable materials.

The sole 14 can include an outsole 24. The outsole 24 is a bottom 48 of the footwear 10 that directly contacts the ground or surfaces on which the wearer is walking or crawling. The outsole 24 can include a lip portion 46 that extends from the bottom of the shoe. The lip portion 46 can be connected to the upper 12 via the thread 13. When joining the upper 12 and the lip portion 46, the thread 13 creates ripples 42 and angled outside stitches 40.

Figure 2:
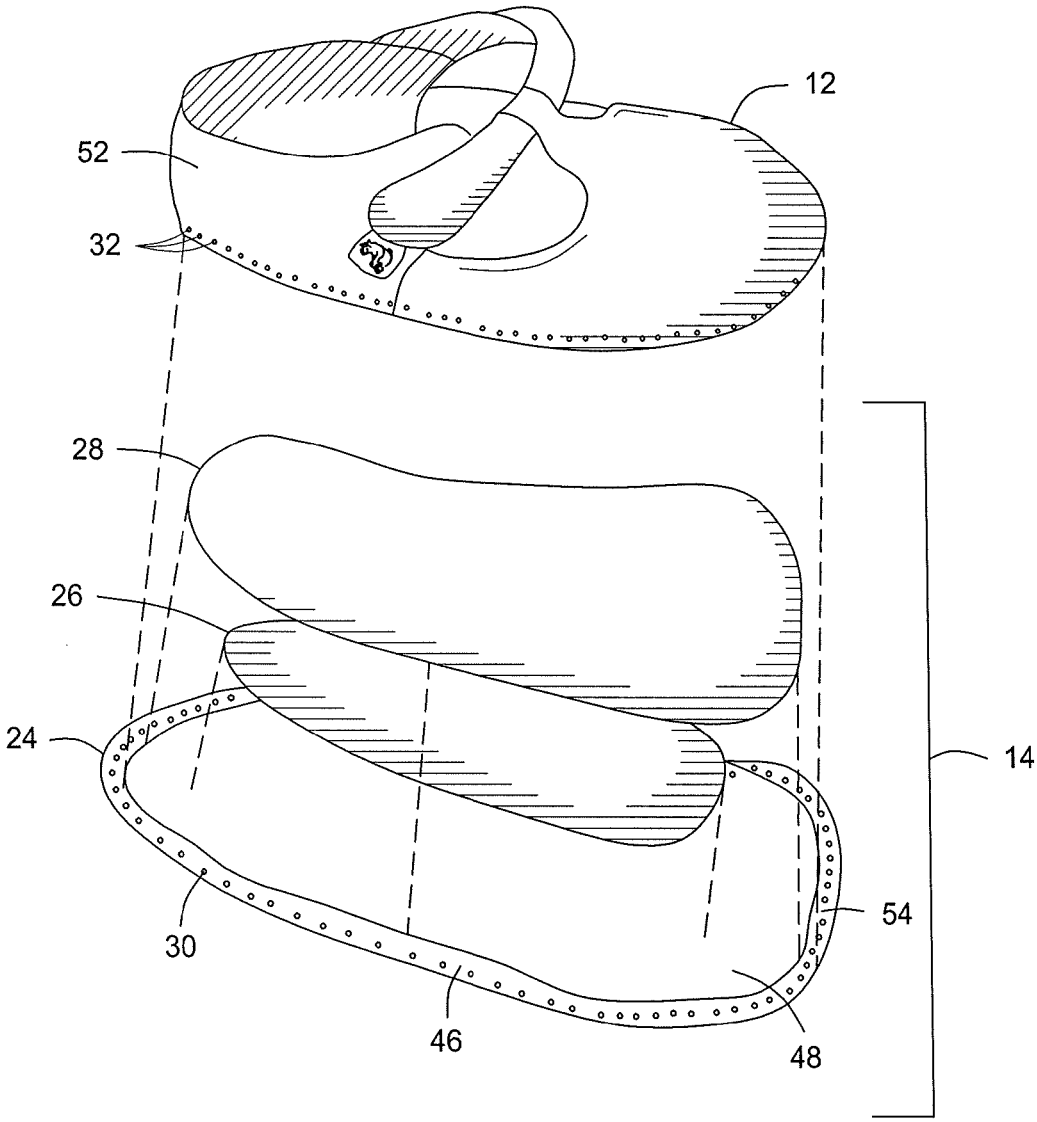
FIG. 2 is an exploded view of the footwear according to the present invention showing various subparts of the footwear.

FIG. 2 is an exploded view of the footwear according to the present invention showing various subparts of the footwear. The upper 12 can include a series of holes 32 along its peripheral 52. In addition, the upper 12 can also include an inside layer (not shown) that is made from different materials than the outer layer 16. Furthermore, additional padding materials may be added between the outer layer 16 and the inside layer to add comfort or support to the footwear.

The sole 14 can include the outsole 24, an insole 28, and middle layer 26. The outsole 24 is slightly larger in area than the insole 28 and the middle layer 26, thus providing the lip 46 around the outsole 24. In addition, the lip 46 has a series of holes 30 along its peripheral 54.

The outsole 24 can be made of materials such as patent leather, genuine leather, leather rawhide, napa leather, polyester urethane material, suede, and other suitable leather type materials. In addition, the outsole 24 can be stamped with a napa print or can be smooth.

The insole 28 can be made of materials such as pigskin, synthetic pigskin, polyester urethane, and other suitable materials. The middle layer 26 can be a foam cushion made with materials such as closed cell foam, ethylene vinyl acetate, or other suitable materials.

The materials for the sole are selected such that soft, lightweight, and flexible footwear is provided to accommodate the growing feet of infants and young children. Furthermore, the footwear 10 can be bent, folded, and rolled up without causing damage to the footwear.

The materials are also selected such that they can provide appropriate protection for the feet of infants and young children. Furthermore, leather is used because of its breathability. In addition, non-toxic leathers or materials are chosen for the footwear because infants and young children often like to put foreign objects into their mouths. Furthermore, the length of the footwear is between 3 inches and 9 inches. The length of the footwear can also be between 4 inches and 7 inches.

Figure 3:
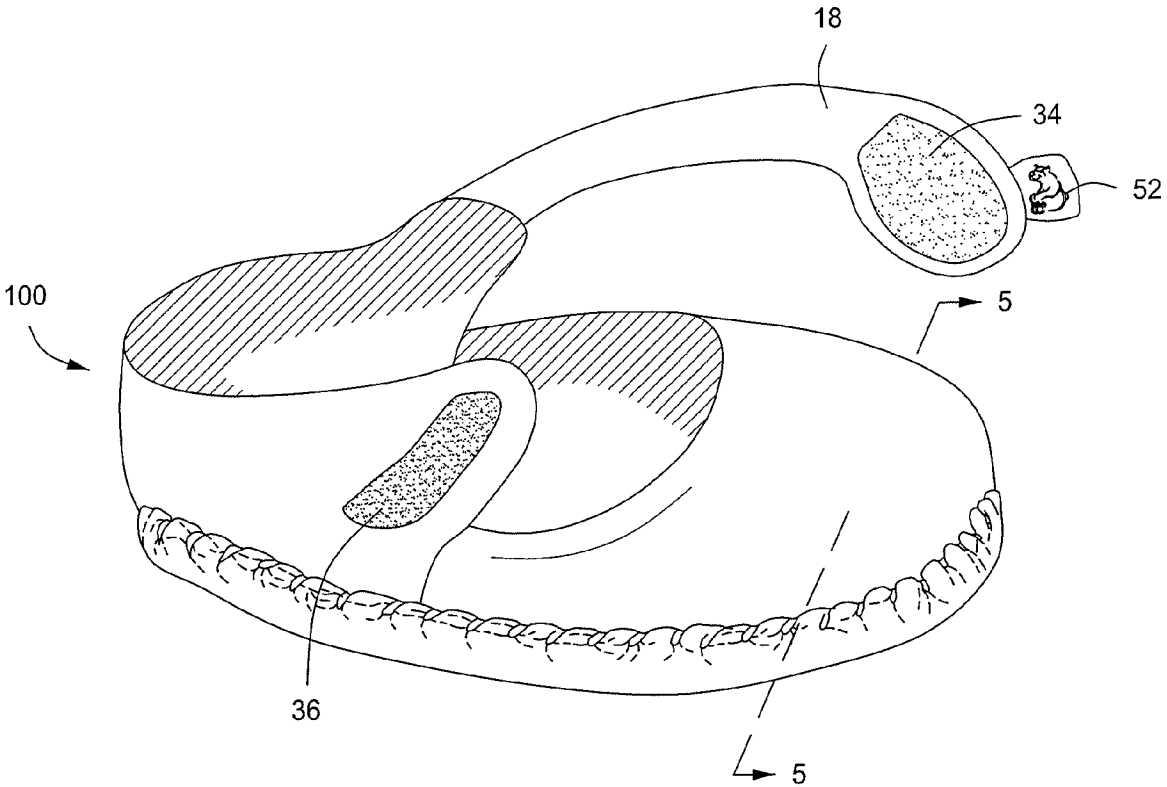
FIG. 3 is a perspective view illustrating the removability of the strap according to the present invention.

FIG. 3 is a perspective view illustrating the removability of the strap according to another embodiment of the present invention. In this embodiment, the footwear 100 is without a vamp portion. Nonetheless, the strap 18 is the same as the one in footwear 10. One end of the strap 18 is connected to the upper 12 and the other end of the strap 18 is provided with one side 34 of a two-sided fastener, the second side 36 of the two sided fastener is attached to the upper 12 of the footwear 100. One example of a two-sided fastener is VELCRO®, but other types of fasteners with similar suitability can also be used. The use of a two-sided fastener allows a caretaker to easily put on and remove the footwear from the infant's or child's feet. Furthermore, the footwear is secure on the children's feet regardless of whether the child wearing the footwear is crawling or walking.

Figure 4:
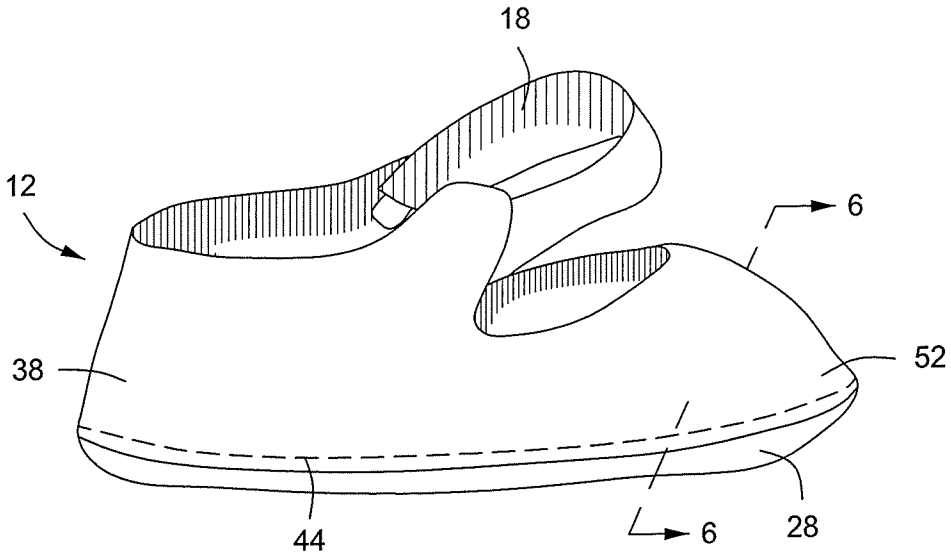
FIG. 4 is a side view of the inside of the footwear showing the inside stitches in accordance with one embodiment of the present invention.

FIG. 4 is a side view of the inside 38 of the footwear 10 showing the inside stitches in accordance with one embodiment of the present invention. The footwear 10 is turned inside-out in order to demonstrate the inside stitches 44 of the footwear 10. The inside stitches 44 are horizontal stitches along the peripheral 52 of the upper 12.

Figure 5:
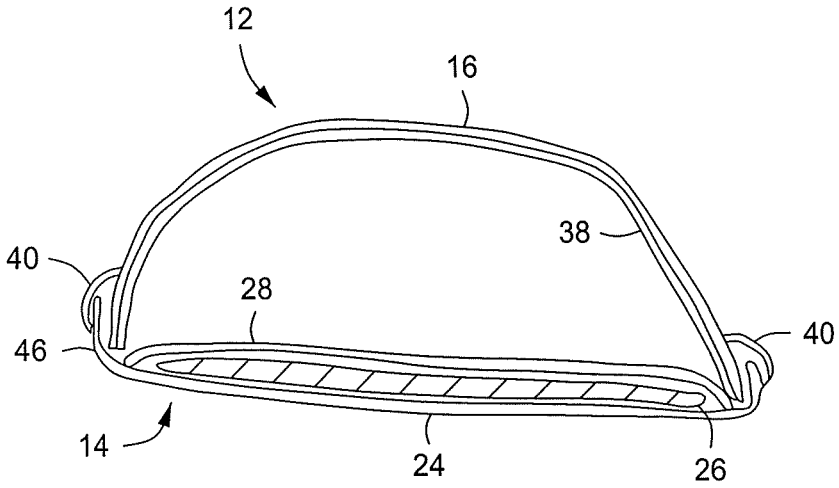
FIG. 5 illustrates a cross-sectional view taken along the 5-5 in FIG. 3.

FIG. 5 illustrates a cross-sectional view taken along the 5-5 in FIG. 3. The upper 12 can include the outer layer 16 and the inside layer 38. The sole 14 can include the outsole 24, the middle layer 26, and the insole 28. The outsole 24 is larger in area than the middle layer 26 and the insole 28, therefore, the lip 46 extends upward and overlaps with the upper 12 upon stitching the two layers together.

Figure 6:
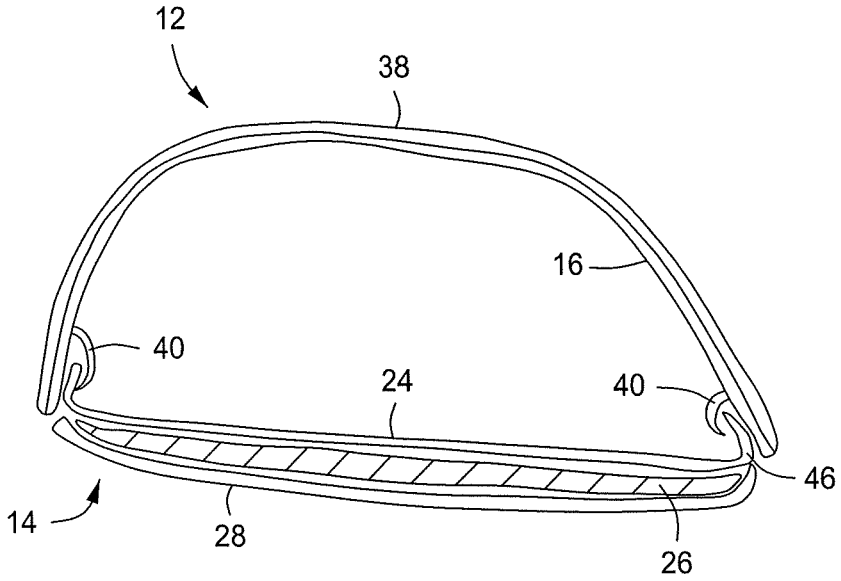
FIG. 6 illustrates a cross-sectional view taken along the 6-6 in FIG. 4.

FIG. 6 illustrates a cross-sectional view taken along the 6-6 in FIG. 4. The outsole 24 is connected to the upper 12 via stitches at the lip 46. The insole 28 can be stitched along with the outsole 24 to the upper 12 via stitch 40.

Figure 7:
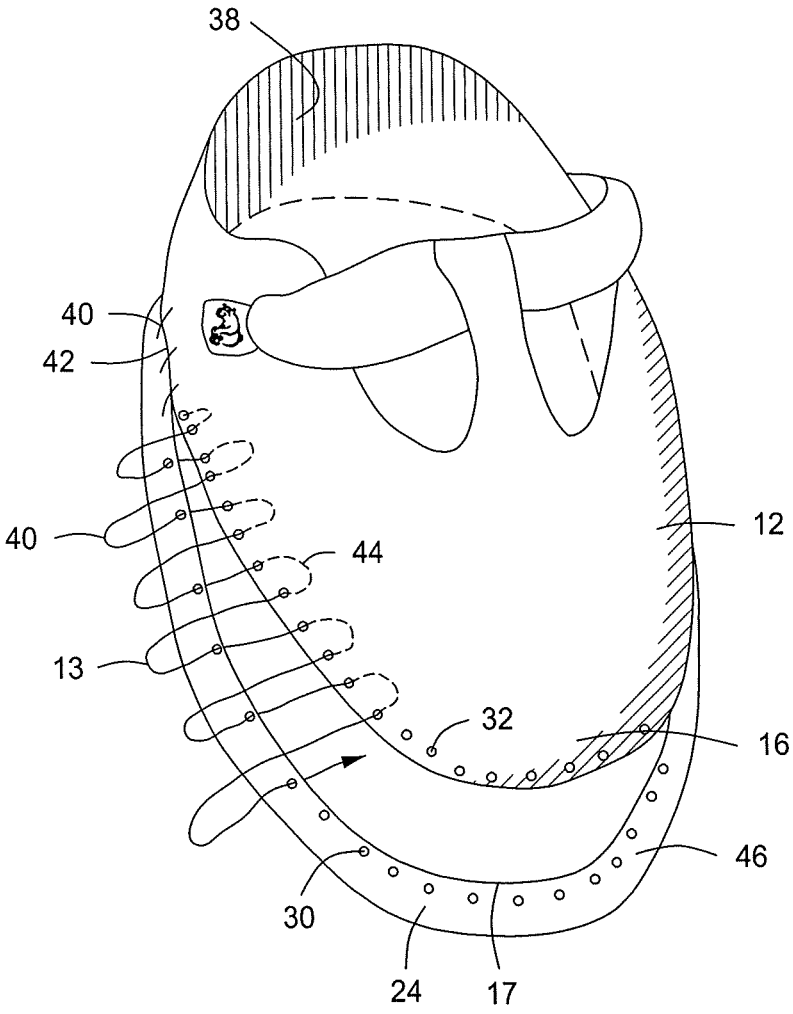
FIG. 7 illustrates a partially stitched footwear showing the stitching method in accordance with the present invention.

FIG. 7 illustrates partially stitched footwear showing the stitching method in accordance with the present invention. This stitching method produces footwear that provide ventilation for the infants' and young children's feet. The method of stitching the upper 12 and the outsole 24 can start by first sending the thread 13 through an upper-hole 32 from the inside 38 of the upper 12; and entering a sole-hole 30 from the outside 17 of the outsole 24, thereby forming a first angled outside stitch 40 on the lip portion 46. Next, the thread 13 enters a second upper-hole 32 from the outside 16 of the upper 12, thus securing the upper 12 and the outsole 24 with the angled outside stitch 40. Then, the thread 13 exits from a third upper-hole 32 from the inside 38 of the upper 12, thereby forming a horizontal stitch 44 on the inside 38 of the footwear 10. This stitching method is continued until the upper 12 and the outsole 24 is completely stitched together. Furthermore, the stitches are manually sewn.

Figure 8A:
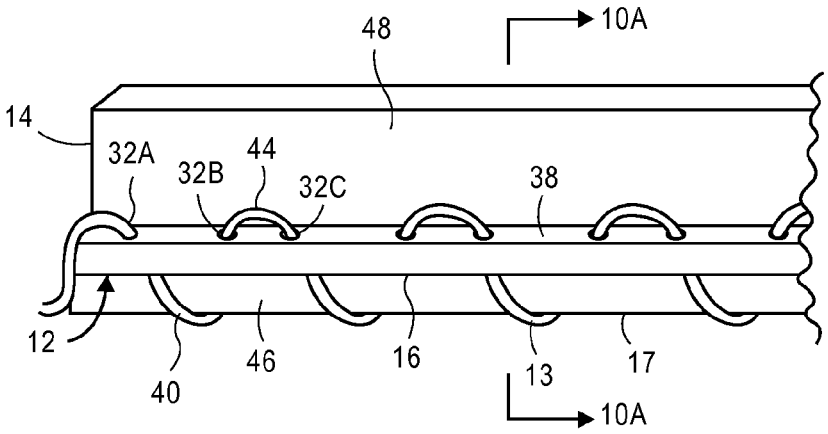
FIG. 8A is a detailed view of the stitches of the footwear when the stitch is not pulled tight.

FIG. 8A is a detailed view of the stitching of the footwear 10 when the stitching is not pulled taut in order to illustrate the horizontal stitches 44 of the inside layer 38 and the angled stitches 40 of the outside layer 16 of the footwear. (For the purpose of better illustrating the stitching, the portion of the upper 12 above the stitching is removed.) As shown, lip 46 of the sole 14 is stitched together with the upper 12 by the thread 13. The thread 13 passes through the first upper-hole 32*a* from the inside 38 of the upper 12, enters a sole-hole 30 (not shown here) from the outside 17 of the outsole 24 and forms an angled stitch 40. The thread 13 then enters a second upper-hole 32*b* from the outside 16 of the upper 12, exits though a third upper-hole 32*c* from the inside 38 of the upper 12, and forms the horizontal stitch 44.

Figure 8B:
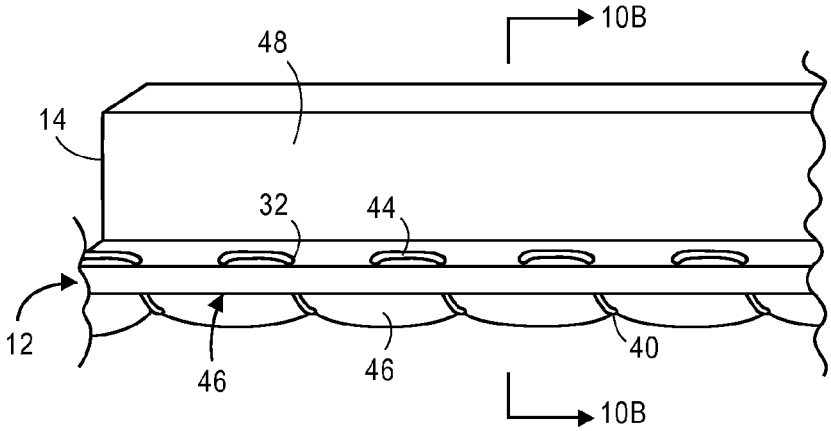
FIG. 8B is a detailed view of the stitches of the footwear when the thread is pulled tight.

FIG. 8B is a detailed view of the stitching of the footwear when the thread is pulled taut to illustrate the ripples and the embedded angled stitch 40 according to an embodiment of the present invention. When the thread 13 is pulled taut in a localized area of the lip portion 46 of the outsole 24, ripples 42 are formed between every two angled stitches 40. As a result, the angled stitch 40 is embedded between two ripples 42. This stitching method provides footwear that can withstand continuous rubbing or contact with rough surfaces without causing damage to the thread 13 because the thread is embedded between the ripples 42 of the lip portion 46 of the footwear 10.

Figure 9:
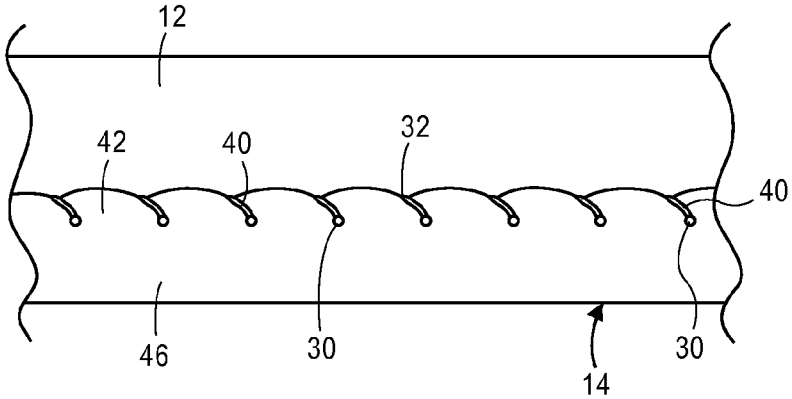
FIG. 9 is another detailed view of the footwear demonstrating the relationship between the ripples and the stitches.

FIG. 9 is another detailed view of the footwear demonstrating the relationship between the ripples 42 and the stitches 40. As discussed previously and as shown here, the ripples 42 are created by the stitches 40 and in turn, the stitches 40 are embedded between the ripples.

The thread is made of materials such as fishline, nylon, polypropylene, ultra high molecular weight polyethylene, braided fused line, cofilament fused line, thermally fused lines, a combination thereof, or other suitable materials. An example of fishline that can be used as thread is the POWER-PRO® line of product manufactured by Innovative Textiles, Inc.

Figure 10A:
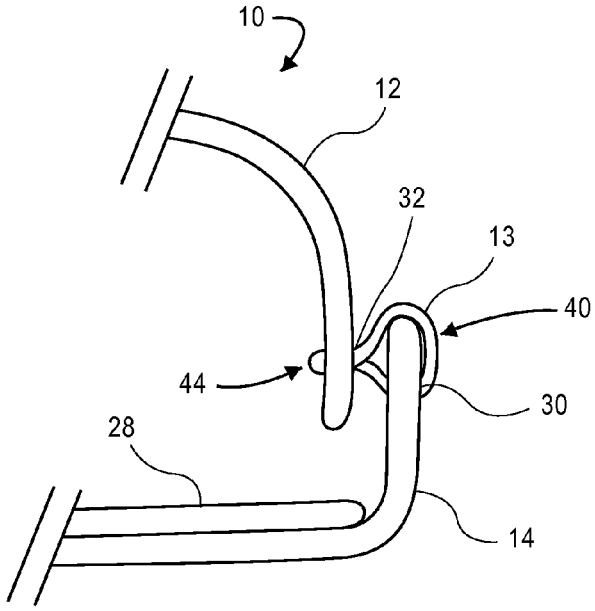
FIG. 10A is a cross-sectional view taken along the 10A-10A in FIG. 8A.

FIG. 10A is a cross-sectional view taken along the 10A-10A in FIG. 8A. As shown in FIG. 10A, the thread 13 passes through the hole 32 in the upper 12, passes up and over the sole 14 and then through the sole 14 via the hole 30 and then back through the upper 12 via another hole 32. The inside stitches 44 generally advance along a longitudinal axis of the footwear 10 while the outside stitches 40 proceed in a series of diagonal lines. As a result of this non-alignment, as the stitching is pulled taut, the material along the path of the stitching is subjected to stresses which act to generate the ripples 42 shown in FIG. 10B.

Figure 10B:
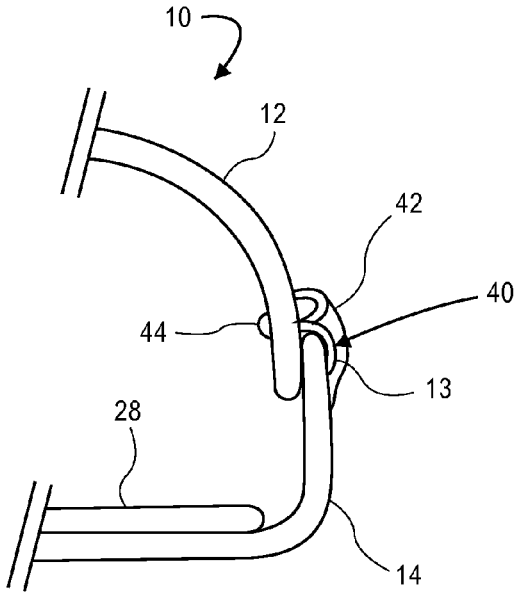
FIG. 10B is a cross-sectional view taken along the 10B-10B in FIG. 8B.

FIG. 10B is a cross-sectional view taken along the 10B-10B in FIG. 8B. As shown in FIG. 10B, the ripples 42 extend out from the footwear 10 such that the outside stitches 40 are embedded within the ripples 42 and thus protected from abrasion. In this manner, the thread 13 is protected and has improved abrasion resistance as compared to conventional footwear that lacks the ripples 42.

Figure 11A:
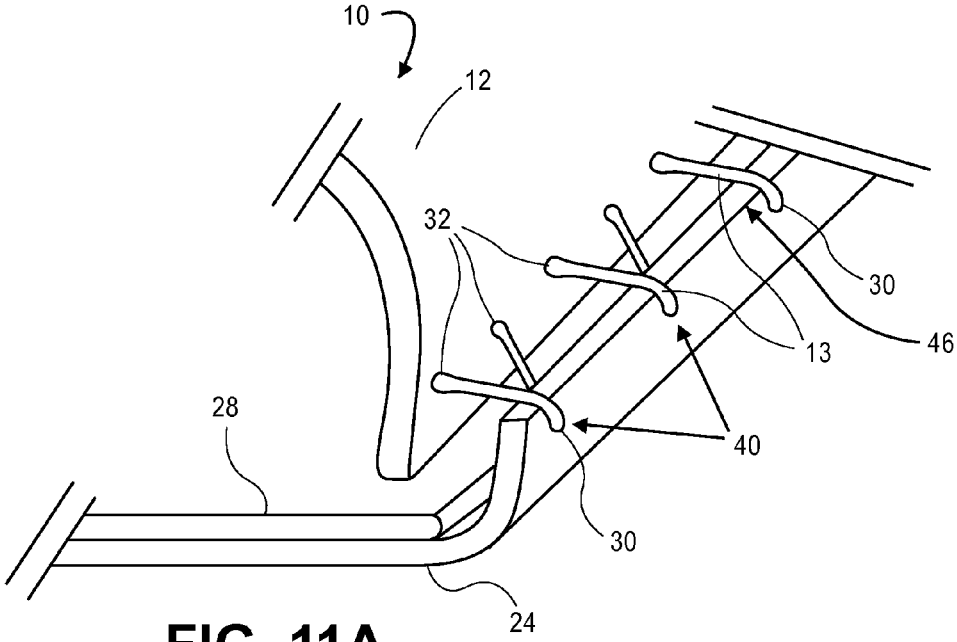
FIG. 11A is an orthogonal projection of the cross-sectional view taken along the 10A-10A in FIG. 8A.

FIG. 11A is an orthogonal projection of the cross-sectional view taken along the 10A-10A in FIG. 8A. As shown in FIG. 11A, the thread 13 is again shown clearly passing the hole 32 in the upper 12, up and over the sole 14 and then through the sole 14 via the hole 30 and then back through the upper 12 via another hole 32. Again, the inside stitches 44 generally advance along a longitudinal axis of the footwear 10 while the outside stitches 40 proceed in a series of diagonal lines. As a result of this non-alignment, as the stitches are pulled taut, the material of the lip portion 46 of the outsole 24 along the path of the stitching is subjected to stresses which locally deform the outsole 24 near the lip portion 46 and act to generate the ripples 42 shown in FIG. 10B.

Figure 11B:
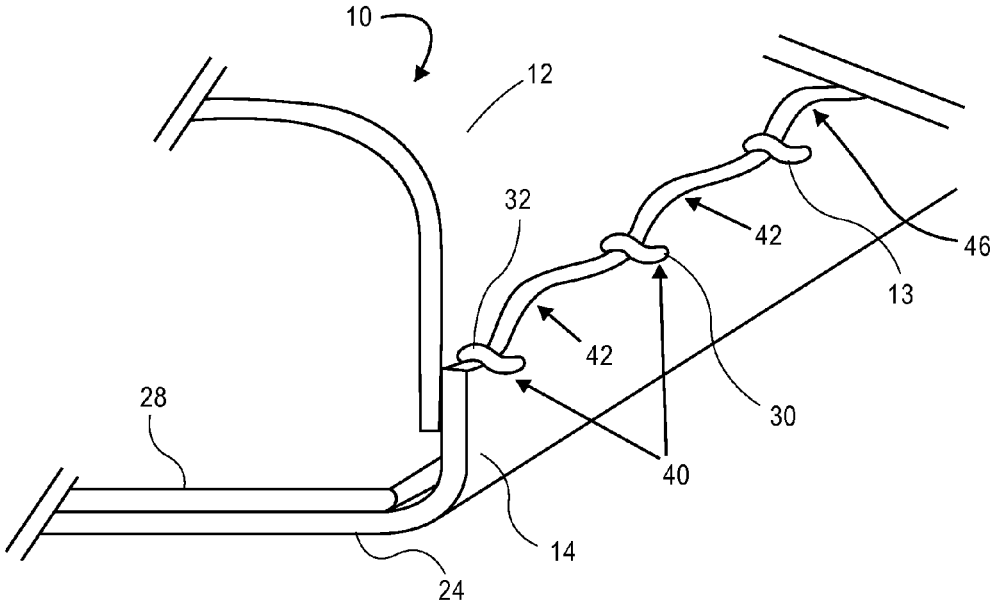
FIG. 11B is an orthogonal projection of the cross-sectional view taken along the 10B-10B in FIG. 8B.

FIG. 11B is an orthogonal projection of the cross-sectional view taken along the 10B-10B in FIG. 8B. As shown in FIG. 11B, the ripples 42 are generated by the torsional stress exerted on the sole 14 along the holes 30 as a result of the thread 13 being urged longitudinally by the longitudinally arrayed holes 32. While not shown in FIG. 11B, this torsional stress may also pull the inside stitches 44 somewhat out of alignment.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method of making a footwear having improved abrasion resistance, the method comprising the steps of:

disposing an upper of the footwear in cooperative alignment with a sole of the footwear;

stitching the upper to the sole with a thread, the upper having upper holes around an upper peripheral, the sole having a lip portion on a sole peripheral, wherein the lip portion has sole holes around the sole peripheral and the sole holes being half as numerous as the upper holes, the thread attaching the upper and the sole through the upper holes and the sole holes by a series of diagonal stitches disposed along the lip portion, wherein each diagonal stitch of the series of diagonal stitching is formed by the thread being passed into a first upper hole of the upper holes, out a second upper hole of the upper holes, over and diagonally across an outside of the lip portion and into a sole hole of the sole holes, wherein a ripple is formed between each pair of adjacent diagonal stitches;

stitching at least one horizontal stitch on the inside portion of the footwear by threading the thread from the sole hole through a third upper hole and threading the thread through a fourth upper hole from the inside of the footwear; and pulling the stitches taut, wherein the diagonal stitches pull the upper holes and the sole holes out of alignment and the thread is disposed relatively below the ripple.

2. The method according to claim 1, further comprising the step of:

affixing a strap to the upper, wherein a portion of the strap is attached to one side of a two-sided fastener, and wherein a second side of the two-sided fastener is attached to the footwear.

3. The method according to claim 1, further comprising the step of:

assembling the sole comprising an outsole, a middle portion, and an insole by disposing the middle portion between the outsole and the insole and affixing the outsole to the insole.

4. The method according to claim 3, further comprising the step of:

forming the insole smaller in dimension than the outsole, wherein the lip portion does not consist of the insole.

5. The method according to claim 3, further comprising the step of:

forming the outsole from materials selected from a group consisting of patent leather, genuine leather, leather rawhide, napa leather, polyester urethane material, suede, and other suitable materials.

6. The method according to claim 3, further comprising the step of:

forming the insole from materials selected from a group consisting of pigskin, synthetic pigskin, polyester urethane, and other suitable materials.

7. The method according to claim 3, further comprising the step of:

forming the middle portion from foam.

8. The method according to claim 1, further comprising the step of:

forming the upper from materials selected from a group consisting of patent leather, genuine leather, leather rawhide, napa leather, polyester urethane material, suede, polyester fabric, cotton fabric, synthetic fabric, and other suitable materials.

9. The method according to claim 1, further comprising the step of:

forming the footwear from flexible materials and the footwear is capable of being bended, folded, or rolled up without causing damage to the footwear.

10. The method according to claim 1, further comprising the step of:

selecting a material for the thread from a group consisting of fishline, nylon, polypropylene, ultra high molecular weight polyethylene, braided fused line, cofilament fused line, thermally fused line, a combination thereof, and other suitable materials.

11. The method according to claim 10, further comprising the step of:

selecting an ultrahigh molecular weight polyethylene fiber material for the thread.

12. The method according to claim 1, further comprising the step of:

embedding the thread between the ripples on the lip portion on the sole peripheral.

* * * * *